United States Patent [19]

Bishop et al.

[11] 4,171,231

[45] Oct. 16, 1979

[54] COATING SOLUTIONS OF TRIVALENT CHROMIUM FOR COATING ZINC SURFACES

[75] Inventors: Craig V. Bishop, Cleveland; Thomas J. Foley, Shaker Heights; James M. Frank, Olmsted Falls, all of Ohio

[73] Assignee: R. O. Hull & Company, Inc., Cleveland, Ohio

[21] Appl. No.: 899,543

[22] Filed: Apr. 27, 1978

[51] Int. Cl.[2] ..... C23F 7/26

[52] U.S. Cl. ..... 148/6.21; 148/6.2

[58] Field of Search ..... 148/6.21, 6.2

[56] References Cited

U.S. PATENT DOCUMENTS

| | | | |
|---|---|---|---|
| 2,559,878 | 7/1951 | Johnson | 148/6.21 |
| 3,535,168 | 10/1970 | Thompson | 148/6.2 X |
| 3,932,198 | 1/1976 | Schneider | 148/6.2 |

FOREIGN PATENT DOCUMENTS

| | | | |
|---|---|---|---|
| 2526832 | 1/1976 | Fed. Rep. of Germany | 148/6.2 |
| 586517 | 3/1947 | United Kingdom | 148/6.21 |

*Primary Examiner*—Ralph S. Kendall

*Attorney, Agent, or Firm*—Maky, Renner, Otto & Boisselle

[57] ABSTRACT

Aqueous acidic coating solutions are described for treating zinc or zinc alloy surfaces comprising trivalent chromium as substantially the only chromium ion present, fluoride ion, an acid other than nitric acid, and an oxidizing agent. The coating solutions containing trivalent chromium as substantially the only chromium ion present preferably are prepared by reducing an aqueous solution of hexavalent chromium with sufficient reducing agent to reduce all of the hexavalent chromium to trivalent chromium. Chromate coatings on zinc and zinc alloy surfaces are produced by contacting said surfaces with an aqueous acidic solution of the invention.

18 Claims, No Drawings

COATING SOLUTIONS OF TRIVALENT CHROMIUM FOR COATING ZINC SURFACES

BACKGROUND OF THE INVENTION

This invention relates to coating solutions containing trivalent chromium for treating zinc or zinc alloy surfaces, and more particularly, to new acidic coating solutions comprising trivalent chromium, fluoride ion, an acid other than nitric acid, and an oxidizing agent. The invention also related to a method for depositing chromate coatings on zinc or zinc alloy surfaces and to metal articles having zinc or zinc alloy surfaces which are chromate coated.

Various conversion coatings on metal surfaces have been suggested in the prior art for the purpose of forming a coating which protects the metal against corrosion and also serves as a base for improving the adhesion of subsequently applied siccative organic finishes. Such conversion coatings are applied by treatment of the surfaces with solutions of various chemicals which react with the surface to form the desired coating. Among the commonly used conversion coating compositions are aqueous phosphate and chromate solutions. Among the simplest of the phosphate compositions are the so-called iron phosphates which comprise, for example, solutions of alkali metal phosphates, and which react with the iron on the metal surface to form an iron phosphate coating.

It also has long been known that surfaces of zinc and zinc-based alloys can be protected against corrosion by treatment with an acid solution containing hexavalent chromium. It was suggested that the attack of the solution on the surface was facilitated if the solution initially contained a small amount of trivalent chromium, and it has been proposed to introduce this trivalent chromium by adding a compound of trivalent chromium, or preferably by adding a small amount of a suitable reducing agent. As the solutions are used, more trivalent chromium is formed by reduction of hexavalent chromium at the zinc surfaces so that the concentration of trivalent chromium progressively increases and the solution eventually has to be discarded when the quality of the coating is affected by the deterioration of the solution. Examples of patents which describe solutions containing mixtures of trivalent chromium and hexavalant chromium include U.S. Pat. Nos. 3,880,772; 3,795,549; 3,553,034; 3,404,046; 3,090,710; 2,911,332; and 2,902,392.

The treatment of zinc surfaces with solutions wherein chromium is entirely in a trivalent state is disclosed in, for example, U.S. Pat. Nos. 3,932,198; 3,647,569; 3,501,352; and 2,559,878. Trivalent chromium solutions also are disclosed in British Pat. No. 1,461,244.

The prior art chromium solutions and the coatings obtained therefrom have not been entirely satisfactory in that they have not always been able to meet the requirements of the zinc plating industry. One of the important requirements of the chromium-containing solution is the ability of the solution to impart a clear to light blue finish on the zinc or zinc alloy surface. In the past, the achievement of this finish on zinc plated from a cyanide containing solution was a relatively easy process using conventional chromates containing hexavalent chromium compounds sometimes in combination with other species such as nitrates, fluorides, sulfates, etc. However, with the advent of alkaline non-cyanide type zinc plating solutions, the production of the proper finish of the zinc after chromating has been a difficult procedure. The difficulties generally have been thought to result from the co-deposition and inclusion of relatively large amounts of organic materials from the zinc brightener components.

Another problem area in chromating is that of iron contamination of the plating bath which causes black staining of the zinc plate when chromated. This problem frequently is encountered in alkaline non-cyanide baths that have been converted from cyanide containing baths. Cyanide baths generally contain relatively large amounts of complexed iron in the form of ferrocyanides. When the free cyanide concentration of the bath reaches approximately zero, these ferrocyanides begin to decompose during electrolysis, and iron is codeposited in the zinc deposit. This problem also can occur in non-cyanide zinc baths which utilize strong chelating or complexing agents as part of the additive system. The source of iron in this case generally is from drag-in of dissolved iron from the preceding acid pickling tanks. The iron staining problem is most frequently encountered in acid zinc plating baths where the pH is low enough that iron can be dissolved in the bath either from non-plated areas of the parts being processed or from parts laying in the bottom of the plating tank. The generally accepted explanation for the black staining is that the hexavalent chromium compounds used in conventional chromates react with codeposited iron to form black iron oxides.

Another disadvantage of hexavalent chromium type solutions is in the area of waste disposal. Recent emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive.

Another problem which has been observed with chromate finishes which have been described previously is the unacceptable adhesion characteristics when certain paints have been applied over the chromate coatings, particularly on exposure to salt spray.

SUMMARY OF THE INVENTION

It now has been found that a highly desirable clear to light blue chromate finish on all types of zinc plate which imparts superior corrosion resistance to the zinc surface can be obtained with an aqueous acidic coating solution comprising trivalent chromium as substantially the only chromium ion present, fluoride ion, an acid other than nitric acid and an oxidizing agent. Preferably, the acid is sulfuric acid, the oxidizing agent is a peroxide, and the solution also contains a small amount of a cationic wetting agent. The trivalent chromium solution may be prepared by reducing an aqueous solution of hexavalent chromium with sufficient reducing agent to reduce all of the hexavalent chromium to trivalent chromium. The aqueous acidic coating solutions of the invention have been found to achieve a satisfactory single dip chromate finish on all types of zinc plate over a wide operating range whether the zinc plate has been deposited by a cyanide or non-cyanide type zinc plating bath. Metal articles having zinc or zinc alloy surfaces which have been treated with the aqueous acidic coating solutions of the invention exhibit the desired clear to light blue finish and are characterized by superior corrosion resistance.

DESCRIPTION OF THE PREFERRED EMBODIMENTS

The aqueous acidic coating solutions of the invention which are useful for treating a zinc or zinc alloy surface comprise a mixture of trivalent chromium as substantially the only chromium ion present, fluoride ion, an acid other than nitric acid, and an oxidizing agent. As a source of trivalent chromium solutions, solutions of chromium sulfate or chromium nitrate, for example, may be used, but the preferred trivalent chromium solutions are those prepared by reduction of an aqueous hexavalent chromium-containing solution. Various water-soluble or water-dispersible sources of hexavalent chromium may be used in the preparation of the trivalent chromium solution provided that the anions or cations introduced with the hexavalent chromium do not have a detrimental effect on either the solution itself or on the coated zinc surfaces. Examples of hexavalent chromium materials which may be used are chromic acid ($CrO_3$), the alkali metal chromates such as sodium chromate and potassium chromate, the alkali metal dichromates such as sodium dichromate and potassium dichromate, etc.

Methods for reducing hexavalent chromium with organic and inorganic reducing agents are generally known in the art. For example, U.S. Pat. Nos. 3,063,877 and 3,501,352 describe methods for reducing chromium trioxide with aldehydes and alcohols such as formaldehyde and butyl alcohol. However, the amount of reducing agent used in accordance with those patents are insufficient for complete reduction of the hexavalent chromium as required in the present invention. Accordingly, the amount of reducing agent used in the present invention is at least the amount required for complete reduction of the hexavalent chromium to trivalent chromium.

Among the suitable inorganic reducing agents are alkali metal iodides, ferrous salts, sulfur dioxide, and alkali metal sulfites, bisulfites and metabisulfites. The alkali metal bisulfites, and especially sodium and potassium metabisulfites are preferred. As mentioned above, the reducing agents are employed in amounts sufficient to completely reduce hexavalent to trivalent chromium, but a substantial excess of sulfite or bisulfite should not be present since the presence of sulfite or bisulfite in the final treatment solution sometimes results in the formation of "blush rust" on the metal surface being treated. In general, the amount of sulfite or bisulfite employed should be less than 1% excess (by weight) or with the stoichiometric amount required for complete reduction of hexavalent to trivalent chromium. If further reducing agent is necessary, methanol or a similar organic reducing agent, or an inorganic reducing agent other than sulfite or bisulfite should be used to complete the reduction.

A preferred procedure for preparing trivalent chromium solutions which may be used in the preparation of the coating solutions of the invention is described in British Pat. No. 1,461,244. A source of hexavalent chromium such as chromic acid flakes is dissolved in water, and the reducing agent is added slowly to control the heat of the reaction and to maintain the reaction mixture at the desired temperature. Cooling may be required if the addition progresses too rapidly.

The source of fluoride ion on the aqueous acidic coating solutions of the invention may be any soluble fluoride compound so long as the ions introduced with the fluoride ion are not detrimental to the performance of the solution. Either metal or ammonium fluorides may be used. Typical fluoride materials include hydrofluoric acid, alkali metal fluorides and alkali metal hydrogen fluorides such as sodium fluoride, ammonium fluoride, sodium hydrogen fluoride, ammonium hydrogen fluoride, etc. Since high water-solubility is desired whenever possible, highly soluble fluorides such as the sodium or ammonium bifluorides are preferred.

The acid which is used in the preparation of the coating solutions of the invention may be organic acids or mineral acids other than nitric acid. Examples of useful organic acids include formic acid, acetic acid, and propionic acid. Useful acids also include sulfuric acid, hydrochloric acid, hydrofluoric acid, sulfamic and phosphoric acid. Sulfuric acid is the preferred acid.

The oxidizing agents which are used in the preparation of the coating solutions of the invention preferably are inorganic halates or peroxides. Examples of inorganic halates include the alkali metal bromates and chlorates. The peroxide oxidizing agent may be hydrogen peroxide, organic peroxides such as urea peroxide or a metal peroxide such as sodium peroxide, potassium peroxide, zinc peroxide, strontium peroxide, barium peroxide or lead dioxide. Generally, hydrogen peroxide is preferred since it does not introduce any extraneous ions which might adversely affect the performance of the coating solution.

The aqueous acidic coating solutions of the invention also may contain a small amount of a cationic wetting agent. The presence of such wetting agents improves the stability of the coating solutions and appears to passivate the zinc or zinc alloy surfaces resulting in improved corrosion protection for the chromatecoated surface. The types of cationic wetting agents which preferably are included in the coating solutions of the invention include those derived from aliphatic amines and more particularly a series of amine-based cationic wetting agents available from the Armak Company under the general trade designations "Armohib 25", "Armohib 28" and "Armohib 31".

The aqueous acidic coating solutions of the invention generally will contain from about 0.1 to about 1 gram per liter and preferably from about 0.3 to about 0.7 gram per liter of trivalent chromium ion, sufficient acid, preferably a mineral acid other than nitric acid, to lower the solution pH to between about 1 to 4 and preferably between about 1 to 3. The amount of oxidizing agent included in the coating solutions of the invention is an amount of which is sufficient to oxidize the trivalent chromium to hexavalent chromium at the interface of the zinc surface and the coating solution where the pH is greater than the pH of the bulk of the solution. The concentration of the oxidizer is determined by the appearance of the treated zinc plate which preferably is a blue-white finish.

A preferred method for preparing the coating solutions of the invention involves the preparation first of a trivalent chromium solution from hexavalent chromium by reduction of, for example, chromic acid with a mixture of sodium and potassium metabisulfites, and blending the trivalent chromium solution with the desired quantity of ammonium bifluoride, sulfuric acid and water. The oxidizing agent is added to the above solution to form the working coating solution of the invention. Generally, the oxidizing agent will be added to the chromium solution just prior to use. Additional quantities of the oxidizing agent may be added to the treating solution when needed to control the quality of the chromate deposit on the zinc surface.

The following examples illustrate the preparation of the aqueous acidic coating solutions of the invention. Unless otherwise indicated, all parts and percentages are by weight.

EXAMPLE 1

The solution of this example is prepared by mixing the following ingredients in the amounts and order indicated:

- 1.1% v/v of a $Cr^{III}$ compound formed by reacting 94 g/l of chromic acid with 86.5 g/l of potassium metabisulfite and 64 g/l of sodium metabisulfite in water;
- 3 cc/l of 96% sulfuric acid;
- 3.6 g/l of ammonium bifluoride;
- 0.25 ml/l of an organic addition agent which is a solution of 32 cc/l of Armohib 25 (amine wetting agent available from Akzona Chemicals) in water; and
- 2% v/v of 35% hydrogen peroxide.

EXAMPLE 2

A solution similar to Example 1 is prepared except that the hydrogen peroxide is replaced by 7 g/l of sodium bromate.

EXAMPLE 3

A solution similar to Example 1 is prepared except that the hydrogen peroxide is replaced by 10 g/l of sodium chlorate.

EXAMPLE 4

A solution similar to Example 1 is prepared except that the hydrogen peroxide is replaced by 40 g/l of zinc peroxide.

EXAMPLE 5

A solution similar to Example 1 is prepared except that the hydrogen peroxide is replaced by 20 g/l of urea peroxide.

EXAMPLE 6

A solution is prepared by mixing the following ingredients in the indicated order and amounts:

- 0.5 g/l of $Cr^{III}$ as contained in an aqueous solution of chromium (III) sulfate;
- 3 cc/l of 96% sulfuric acid;
- 3.6 g/l of ammonium bifluoride;
- 0.25 ml/l of the organic addition agent of Example 1; and
- 2% v/v of 35% hydrogen peroxide.

This solution is heated to about 80° C. before being used in order to assure proper hydration of the $Cr^{III}$.

EXAMPLE 7

A solution similar to Example 1 is prepared except that the sulfuric acid is replaced by 4 cc/l of concentrated hydrochloric acid.

EXAMPLE 8

A solution similar to Example 7 is prepared except that the sulfuric acid is replaced by 5 cc/l of 85% phosphoric acid.

EXAMPLE 9

A solution similar to Example 1 is prepared except that the sulfuric acid is replaced by 7 g/l of sulfamic acid.

EXAMPLE 10

A solution similar to Example 1 is prepared except that the organic addition agent comprises 32 cc/l of Armohib 28 in water.

EXAMPLE 11

A solution similar to Example 1 is prepared except that no organic addition agent is included in the solution.

EXAMPLE 12

A solution similar to Example 6 is prepared except that no organic wetting agent is included in the solution.

EXAMPLE 13

A solution similar to Example 6 is prepared except that the trivalent chromium source is about 0.5 g/l of chrome (III) in the form of a chrome (III) acetate solution in water.

In the coating operation in which the method of this invention is used, the zinc surface usually is first cleaned by chemical and/or physical means to remove any grease, dirt or oxides, although such treatments are not always required. After rinsing the surface with water, the zinc surface then is treated with the aqueous acidic coating solutions of the invention. Treatment may be by any of the commonly used techniques such as spraying, brushing, dipping, roller-coating, reverse roller-coating and flow coating. The coating compositions of the invention are particularly useful in a dipping system.

The pH of the coating solutions of the invention during application generally is from about one to about four and preferably between about one to three. Since the concentrate prepared from an already formed trivalent chromium salt (e.g. chromium chloride), or by reduction of hexavalent chromium with certain reducing agents such as sulfur dioxide, may be too acidic to produce a metal cleaning solution having a pH within the desired range, it may be necessary to adjust the pH of the concentrate or treating solution by adding an alkaline reagent thereto. Such reagents include ammonium hydroxide, sodium hydroxide, or potassium hydroxide. When bisulfite is used as the reducing agent for the chromium, it may sometimes be necessary to acidify the water used for diluting the concentrate to form the treating solution so as to avoid the formation of a precipitate or a colloid during dilution. The preferred acid for adjusting the pH of the solution is sulfuric acid.

The temperature of application of the coating solutions to the metal surface usually is between about 10° to 50° C. and is preferably between about 20°-35° C. When the method of application is by dipping or immersion, a dipping or immersion time of about 10 to about 30 seconds and preferably of about 10 seconds is utilized. If additional time is required in order to obtain the desired blue-white finish, this is an indication that the coating composition needs to be replenished with one or more of the ingredients.

Following the chromate treatment, the metal surface may be rinsed with water, usually also at a temperature below about 50° C. and then dried. Drying may be by air-blowing at room temperature or at higher temperatures, usually up to about 65° C.

The conversion coating produced on the zinc surfaces in accordance with the method of this invention generally is a blue-white finish in color. In addition to furnishing the attactive appearance to the metal, the chromate coatings of the invention provide improved corrosion resistance and paint adhesion.

The following examples illustrate the method for coating zinc surfaces with the aqueous acidic compositions of the invention.

EXAMPLE A

Freshly plated zinc panels are immersed in the solution of Example 1 for about 15 to 30 seconds whereupon a blue color appears on the surface. The panels are removed from the solution, rinsed with water and allowed to dry over a period of 48 hours at room temperature. The dried panels are subjected to a 5% neutral salt spray environment. At the end of 24 hours, the panels showed only 0–10% of white corrosion product, and at the end of 50 hours of salt spray environment, some panels still showed no white corrosion.

When the same procedure is carried out on the same type of freshly plated zinc panels except that the coating solution does not contain any hydrogen peroxide, (oxidizing agent), and the treated panels are subjected to the same neutral salt spray environments, the panels showed 80–100% white corrosion at the end of 24 hours.

EXAMPLE B

The procedure of Example A is repeated except that the coating compositon is the composition prepared in Example 12. That is, no organic cationic wetting agent is included in the composition. The chromate coated zinc panels prepared in this manner are found to be slightly more subject to the formation of white rust in the salt spray environment, but these panels exhibit improved corrosicn resistance when compared to a similar coating composition wherein no oxidizing agent is included.

As mentioned earlier, the desirable results which are illustrated in Examples A and B may be obtained with the coating compositions of this invention over all types of zinc plate and over a wide operating range of chromate components. Thus, the coating compositions of the invention are useful over zinc plates deposited by alkaline non-cyanide type zinc plating solutions, alkaline cyanide zinc plating solutions and acid zinc solutions.

After a metal article has been treated in accordance with the method and composition of this invention, it often is preferred to apply an organic coating composition which may be a siccative coating such as a paint, lacquer, varnish, synthetic resin, or enamel, or an electrostatically deposited powder coating. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction. The coated article is dried in a manner best suited for the siccative coating composition employed such as by air-drying at ambient or elevated temperature, baking in an oven, or baking under infra-red lamps. In most instances, the thickness of the dried film of the siccative organic coating composition will be from about 0.1 to about 10 mils, and more often between 0.3 to about 5 mils.

From the above description, it will be apparent that the advantages which are obtained from this invention include the avoidance of hexavalent chromium as a pollutant in the process effluent, ease of control since the need for addition of components can be determined from visual appearance of the parts, ability to use the same chromium solution over almost all types of zinc plate regardless of method of deposition, consistent reproducability of the finished appearance, good paint adhesion of the treated metal and good corrosion resistance, especially when the cationic wetting agents are included in the coating solution.

The embodiments of the invention in which an exclusive property or privilege is claimed are defined as follows:

1. An aqueous acidic coating solution for treating a zinc or zinc alloy surface consisting essentially of trivalent chromium as substantially the only chromium ion present, fluoride ion, an acid other than nitric acid, and an inorganic halate or peroxide.

2. The coating solution of claim 1 wherein the acid is a mineral acid other than nitric.

3. The coating solution of claim 1 wherein the acid is sulfuric, hydrochloric, hydrofluoric, sulfamic, phosphoric or acetic acid.

4. The coating solution of claim 3 wherein the acid is sulfuric acid.

5. The coating solution of claim 1 wherein the peroxide is hydrogen peroxide or a metal peroxide.

6. The coating solution of claim 1 wherein the trivalent chromium is obtained by reduction of an aqueous hexavalent chromium-containing solution.

7. The coating solution of claim 6 wherein the reduction is effected with one or more alkali metal sulfite or bisulfite.

8. The coating solution of claim 1 wherein the solution also contains a cationic wetting agent.

9. An aqueous acidic coating solution for treating a zinc or zinc alloy surface comprising trivalent chromium as substantially the only chromium ion present, fluoride ion, sulfuric acid and hydrogen peroxide.

10. An aqueous acidic coating solution for treating zinc or zinc alloy surfaces comprising from about 0.2 to about 1.0 grams per liter of trivalent chromium ion as substantially the only chromium ion present, from about 0.2 to about 1.0 grams per liter of fluoride ion, from about 3 to about 50 grams per liter of a peroxide, 0 to about 0.1 grams per liter of a cationic wetting agent and a sufficient amount of sulfuric, hydrochloric, acetic, sulfamic or phosphoric acid to regulate the pH of the solution between about 1 to about 4.

11. The acidic coating solution of claim 10 wherein the acid is sulfuric acid.

12. A method of preparing an aqueous acidic coating solution of any of claims 1–11 which consists essentially of the steps of (a) reducing an aqueous solution of hexavalent chromium with sufficient reducing agent to reduce all of the hexavalent chromium to trivalent chromium, (b) mixing the reduced chromium-containing solution with a soluble fluoride compound and an acid other than nitric acid, and (c) adding an inorganic halate or peroxide to the product of step (b).

13. The method of claim 12 wherein the reducing agent is a mixture of alkali metal bisulfites.

14. The method of claim 12 wherein the soluble fluoride is at least one metal or ammonium bifluoride.

15. The method of claim 14 wherein the soluble fluoride is ammonium bifluoride.

16. The method of claim 12 wherein the product of step (b) is prepared as a concentrate and dilute with water before the inorganic halate or peroxide is added in step (c).

17. A method of producing a chromate coating on zinc and zinc alloy surfaces which comprises contacting said surfaces with an aqueous acidic solution of any of claims 1-11.

18. The method of claim 17 wherein the solution is applied to the surfaces at a temperature of from about 10°-50° C. for a period of time of from about 5 to about 30 seconds.

* * * * *